US006787059B2

(12) United States Patent
Takaragi et al.

(10) Patent No.: US 6,787,059 B2
(45) Date of Patent: Sep. 7, 2004

(54) RESIN COMPOSITION FOR BONDED MAGNET AND BONDED MAGNET USING THE SAME

(75) Inventors: Shigeru Takaragi, Hiroshima (JP); Minoru Ohsugi, Hiroshima (JP); Takahiro Araki, Hiroshima-ken (JP); Takayoshi Ohara, Otake (JP)

(73) Assignee: Toda Kogyo Corporation, Hiroshima-ken (JP)

( * ) Notice: Subject to any disclaimer, the term of this patent is extended or adjusted under 35 U.S.C. 154(b) by 12 days.

(21) Appl. No.: 10/388,239

(22) Filed: Mar. 14, 2003

(65) Prior Publication Data

US 2003/0181631 A1 Sep. 25, 2003

(30) Foreign Application Priority Data

Mar. 19, 2002 (JP) ..... 2002-075920

(51) Int. Cl.[7] ..... H01F 1/113; H01F 1/55; H01F 1/08

(52) U.S. Cl. ..... 252/62.54; 528/310

(58) Field of Search ..... 252/62.54; 528/310

(56) References Cited

U.S. PATENT DOCUMENTS 4,462,919 A 7/1984 Saito et al. ..... 252/612.54

FOREIGN PATENT DOCUMENTS

JP 09-283314 * 10/1997

OTHER PUBLICATIONS

Sakata et al, "Development of Extrusion Molded Nd–Fe–B Magnets", 8319 IEEE Translation Journal on Magnetics in Japan, Jan. 8, 1993, No. 1, New York, U.S., pp. 21–26.
Patent Abstracts of Japan vol. 1995, No. 11, Dec. 26, 19995 & JP 07 226312 A, Aug. 22, 1995 Abstract.
Patent Abstracts of Japan vol. 2000, No. 4, Aug. 2000 & JP 2000 003809 A, Jan. 31, 2000 Abstract.
Patent Abstracts of Japan vol. 1998, No. 02, Jan. 30, 1998 & JP 09 283314 A, Oct. 31, 1997 Abstract.

* cited by examiner

*Primary Examiner*—C. Melissa Koslow
(74) *Attorney, Agent, or Firm*—Nixon & Vanderhye P.C.

(57) ABSTRACT

A resing composition for bonded magnet of the present invention comprises:

magnetic particles; and an aromatic polyamide resin comprising an aromatic carboxylic acid and an aliphatic diamine, which has a molar rational of residual end carboxyl groups to residual end amino groups of 0.1 to 1.0 and a solution viscosity of not more than 1.1 dl/g. The resin composition for bonded magnet is excellent inmoldability, and a bonded magnet using such a resing composition is excellent in mechanical strength and heat resistance.

12 Claims, 2 Drawing Sheets

RESIN COMPOSITION FOR BONDED MAGNET AND BONDED MAGNET USING THE SAME

BACKGROUND OF THE INVENTION

The present invention relates to a resin composition for bonded magnet (bond magnet) and a bonded magnet using the same, and more particularly, to a resin composition for bonded magnet, which is excellent in moldability, and a bonded magnet using such a resin composition, which is excellent in mechanical strength and heat resistance.

As well known in the art, bonded magnets have been produced by molding a resin composition comprising a binder resin composed of thermoplastic resins such as polyamide resins and ethylene-ethyl acrylate copolymers, and magnetic particles such as ferrite particles and rare earth magnetic particles, which are mixed with the binder resin. The bonded magnets have an excellent productivity because of a light weight, a less brittleness and a good processability thereof as compared to magnets produced by a sintering method and, therefore, the bonded magnet have been used in extensive applications.

However, the bonded magnets using the binder resin composed of the above-mentioned thermoplastic resins generally show a poor heat resistance and are presently unusable in such applications requiring a high heat resistance.

When polyphenylene sulfide resins showing a relatively high heat resistance among thermoplastic resins are used as the binder resin, the obtained bonded magnets are deteriorated in productivity due to poor moldability and high brittleness thereof.

Meanwhile, the bonded magnets are generally produced by an injection-molding method or an extrusion-molding method. In the injection-molding method, sprues or runners are produced, resulting in loss of materials. To reduce the loss of materials, the thus produced sprues or runners must be recycled. However, in particular, in the case of the bonded magnets using polyphenylene sulfide resins, the recycled resins of the sprues or runners causes problems such as further deteriorated moldability and poor strength of the obtained molded products.

On the other hand, there have been proposed bonded magnets using aromatic polyamide resins having a good heat resistance as a binder resin other than the polyphenylene sulfide resins. However, the heat-resistant aromatic polyamide resins are brittle due to a high crystallinity thereof, and are deteriorated in moldability such as fluidity and recycling property as compared to ordinary aliphatic polyamides, resulting in poor handling property thereof. In order to improve the moldability, various organic additives have been added to the aromatic polyamide resins. However, almost all of these organic additives are decomposed and gasified upon molding because the molding temperature is very high, so that it may be difficult for these additives to exhibit inherent effects of improving the fluidity and preventing the deterioration in quality of resin. In addition, the use of the additives tends to cause problems such as molding defects due to gases generated therefrom and contamination of mold therewith.

Conventionally, there have been proposed various methods for improving properties of bonded magnets by using specific polyamide resins (Japanese Patent Application Laid-Open (KOKAI) Nos. 7-226312(1995), 9-190914 (1997), 9-283314(1997), 11-302539(1999), 9-71721(1997), 2000-3809 and 2000-348918, etc.).

At present, it has been strongly demanded to provide resin compositions for bonded magnet having an excellent moldability, and bonded magnets having excellent mechanical strength and heat resistance. However, the conventional resin compositions for bonded magnet and the conventional bonded magnets have failed to satisfy these requirements.

Namely, in Japanese Patent Application Laid-Open (KOKAI) No. 7-226312(1995), there is described the resin composition for bonded magnet, which comprises a polyamide resin having modified end groups. However, in this KOKAI No. 7-226312, the ratio between contents of end carboxyl groups and end amino groups is not taken into consideration, and the resin composition for bonded magnet described therein fails to exhibit an excellent moldability.

In Japanese Patent Application Laid-Open (KOKAI) No. 9-190914(1997), there is described the bonded magnet using a resin mixture composed of a polyamide resin containing a benzene ring in a main chain thereof and another polyamide resin having a melting point of 270° C. and a crystallinity of not more than 35%. However, in this KOKAI No. 9-190914, the ratio between contents of end carboxyl groups and end amino groups is not taken into consideration, and the resin composition for bonded magnet described therein fails to exhibit a sufficient moldability.

In Japanese Patent Application Laid-Open (KOKAI) No. 9-283314(1997), there is described the bonded magnet using a polyamide resin obtained from terephthalic acid, a dicarboxylic acid component other than terephthalic acid and a diamine component. However, the ratio between contents of end carboxyl groups and end amino groups is not taken into consideration, and the resin composition for bonded magnet described therein fails to exhibit a sufficient moldability.

In Japanese Patent Application Laid-Open (KOKAI) No. 11-302539(1999), there is described the bonded magnet using a polyamide resin obtained from terephthalic acid and an aliphatic diamine. However, the ratio between contents of end carboxyl groups and end amino groups is not taken into consideration, and the bonded magnet described therein fails to exhibit a sufficient mechanical strength because the aliphatic diamine contains a large amount of linear diamine.

In Japanese Patent Application Laid-Open (KOKAI) Nos. 9-71721(1997) and 2000-3809, there is described the bonded magnet using a polyamide resin containing end carboxyl groups and end amino groups at specific concentrations. However, since end amino groups of the polyamide resin are modified with a carboxyl-containing organic compound, the carboxyl concentration in the resin composition becomes excessively high. As a result, the resin composition for bonded magnet described therein fails to show an excellent recycling property.

As a result of the present inventors' earnest studies to solve the above problems, it has been found that by using as a binder an aromatic polyamide resin produced from an aromatic carboxylic acid and an aliphatic diamine, which has a molar ratio of residual end carboxyl groups to residual end amino groups ((end carboxyl groups)/(end amino groups)) of 0.1 to 1.0 and a solution viscosity of not more than 1.1 dl/g, the obtained bonded magnet can exhibit excellent mechanical strength and heat resistance. The present invention has been attained on the basis of this finding.

SUMMARY OF THE INVENTION

An object of the present invention is to provide a resin composition for bonded magnet which can exhibit excellent moldability and recycling property.

Another object of the present invention is to provide a bonded magnet exhibiting excellent mechanical strength and heat resistance.

To accomplish the aims, in a first aspect of the present invention, there is provided a resin composition for bonded magnet, comprising magnetic particles, and an aromatic polyamide resin produced from an aromatic carboxylic acid and an aliphatic diamine, which aromatic polyamide resin has a molar ratio of residual end carboxyl groups content to residual end amino groups content ((end carboxyl groups)/(end amino groups)) of 0.1 to 1.0 and a solution viscosity of not more than 1.1 dl/g.

In a second aspect of the present invention, there is provided a resin composition for bonded magnet, comprising magnetic particles, and an aromatic polyamide resin produced from an aromatic carboxylic acid and an aliphatic diamine composed of a linear diamine and a branched diamine, which aromatic polyamide resin has a molar ratio of residual end carboxyl groups content to residual end amino groups content ((end carboxyl groups)/(end amino groups)) of 0.1 to 1.0 and a solution viscosity of not more than 1.1 dl/g, a molar ratio of the linear diamine content to the branched diamine content ((linear diamine)/(branched diamine)) being less than 4.0.

In a third aspect of the present invention, there is provided a resin composition for bonded magnet, comprising magnetic particles, and an aromatic polyamide resin produced from an aromatic carboxylic acid and an aliphatic diamine composed of a linear diamine and a branched diamine, which has a molar ratio of residual end carboxyl groups content to residual end amino groups content ((end carboxyl groups)/(end amino groups)) of 0.1 to 1.0 and a solution viscosity of not more than 1.1 dl/g, a molar ratio of the linear diamine content to the branched diamine content ((linear diamine)/(branched diamine)) being less than 4.0, and the resin composition having a melt flow rate (MFR) of 70 to 500 g/10 min and a torque increasing time upon kneading in plastomill of 15 to 60 minutes.

In a fourth aspect of the present invention, there is provided a bonded magnet produced by molding a resin composition for bonded magnet, comprising magnetic particles, and an aromatic polyamide resin produced from an aromatic carboxylic acid and an aliphatic diamine, which has a molar ratio of residual end carboxyl groups content to residual end amino groups content ((end carboxyl groups)/(end amino groups)) of 0.1 to 1.0 and a solution viscosity of not more than 1.1 dl/g.

In a fifth aspect of the present invention, there is provided a bonded magnet produced by molding a resin composition for bonded magnet, comprising magnetic particles and an aromatic polyamide resin produced from an aromatic carboxylic acid and an aliphatic diamine, which has a molar ratio of residual end carboxyl groups content to residual end amino groups content ((end carboxyl groups)/(end amino groups)) of 0.1 to 1.0 and a solution viscosity of not more than 1.1 dl/g, the bonded magnet having an IZOD impact strength of 10 to 20 kJ/m$^2$ and a flexural strength of 100 to 180 MPa.

In a sixth aspect of the present invention, there is provided a bonded magnet produced by molding a resin composition for bonded magnet, comprising magnetic particles and an aromatic polyamide resin produced from an aromatic carboxylic acid and an aliphatic diamine composed of a linear diamine and a branched diamine, which has a molar ratio of residual end carboxyl groups content to residual end amino groups content ((end carboxyl groups)/(end amino groups)) of 0.1 to 1.0 and a solution viscosity of not more than 1.1 dl/g, a molar ratio of the linear diamine content to the branched diamine content ((linear diamine)/(branched diamine)) being less than 4.0, and the bonded magnet having an IZOD impact strength of 10 to 20 kJ/m$^2$ and a flexural strength of 100 to 180 MPa.

In a seventh aspect of the present invention, there is provided a resin composition for bonded magnet, comprising magnetic particles, and an aromatic polyamide resin produced from an aromatic carboxylic acid and an aliphatic diamine composed of a linear diamine and a branched diamine, which aromatic polyamide resin has a solution viscosity of not more than 1.1 dl/g, a molar ratio of the linear diamine content to the branched diamine content ((linear diamine)/(branched diamine)) being less than 4.0.

In an eighth aspect of the present invention, there is provided a bonded magnet produced by molding a resin composition for bonded magnet, comprising magnetic particles, and an aromatic polyamide resin produced from an aromatic carboxylic acid and an aliphatic diamine composed of a linear diamine and a branched diamine, which aromatic polyamide resin has a solution viscosity of not more than 1.1 dl/g, a molar ratio of the linear diamine content to the branched diamine content ((linear diamine)/(branched diamine)) being less than 4.0.

DETAILED DESCRIPTION OF THE INVENTION

Figure 1:
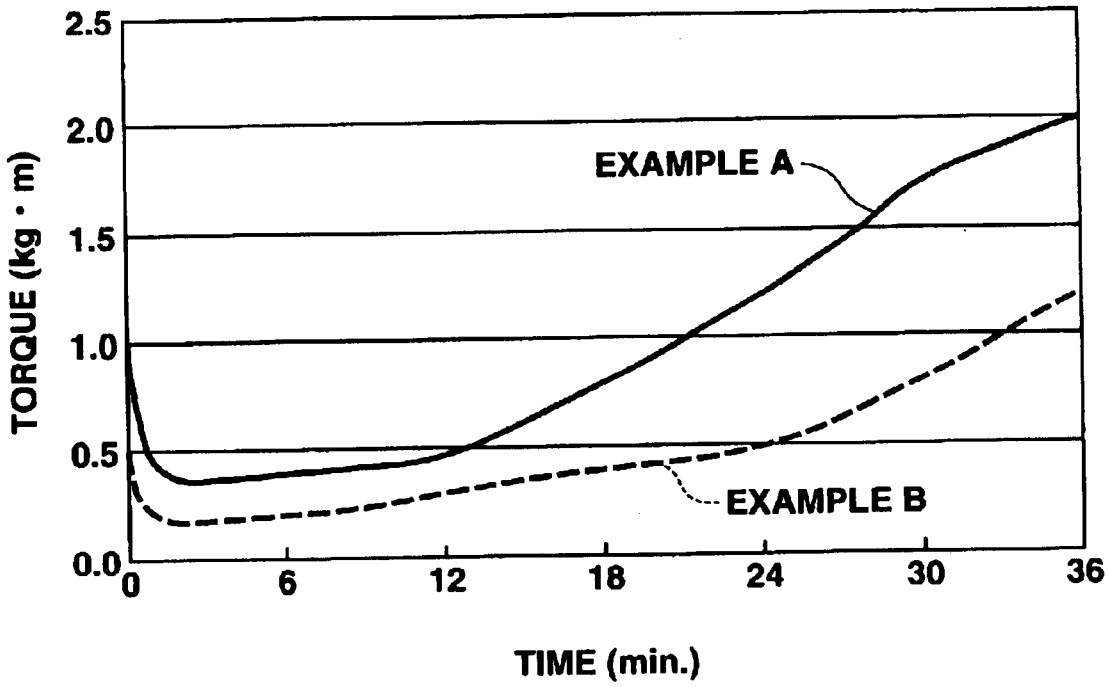
FIG. 1 is a graph showing the change in kneading torque of resin compositions obtained in Examples A and B a with the passage of time upon a solution viscosity of 0.65 dl/g.

The present invention is described in detail below.

First, the aromatic polyamide resin used in the present invention is described.

Examples of the aromatic polyamide resin used in the present invention may include aromatic polyamide resins which are produced from an aromatic carboxylic acid such as terephthalic acid and an aliphatic diamine as constituent monomers. Specific examples of the aromatic polyamide resin may include aromatic polyamides such as modified 6T nylon or 9T nylon. As the aromatic polyamide resin, there may also be used modified aromatic polyamide resins obtained by modifying aromatic polyamide resins with other substances, such as random copolymers, block copolymers and graft copolymers composed of aromatic polyamide resins and other monomers, and a blended mixture of aromatic polyamide resins and other thermoplastic resins. In particular, among these aromatic polyamide resins, preferred is 9T nylon having well-balanced heat stability and moldability.

The aromatic polyamide resin used in the present invention has a solution viscosity of usually not more than 1.1 dl/g, preferably not more than 1.05 dl/g when measured by the below-mentioned method. The lower limit of the solution viscosity is preferably about 0.5 dl/g. When the solution viscosity of the aromatic polyamide resin is more than 1.1 dl/g, the resin composition prepared by blending therein magnet particles in such an amount as required for obtaining a bonded magnet having practical magnetic properties tends to be deteriorated in fluidity, so that it may be difficult to subject the resin composition to injection-molding process. When the solution viscosity is less than 0.5 dl/g, the resin composition and the obtained molded product tend to be deteriorated in strength.

The aromatic polyamide resin used in the present invention has a molar ratio of residual end carboxyl groups content to residual end amino groups content ((end carboxyl groups)/(end amino groups); hereinafter referred to merely as "end group ratio") of usually not more than 1.0, preferably not more than 0.8. The lower limit of the end group ratio is usually about 0.1. When the end group ratio is more than 1.0, the aromatic polyamide resin tends to suffer from cross-linking reaction, resulting in increase of the viscosity thereof. As a result, it may be difficult to subject the resin to kneading and injection-molding processes.

In order to adjust the end group ratio of the aromatic polyamide resin to 0.1 to 1.0, the amount of the residual end groups in the aromatic polyamide resin may be controlled by ordinary methods. For example, upon synthesis of the polyamide, a suitable end modifier may be added to monomers used for production of the above aromatic polyamide resin, thereby adjusting the amounts of the end groups contained therein. Alternatively, the end modifier may be added to the resultant polyamide resin to transform reactive end groups thereof into other non-reactive end groups, thereby adjusting the amounts of the end groups contained therein.

The amount of the residual amino groups contained in the aromatic polyamide resin used in the present invention is preferably not less than 0.5 mol %. The upper limit of the amount of the residual amino groups is preferably about 1.25 mol %. When the amount of the residual amino groups contained in the aromatic polyamide resin is less than 0.5 mol %, deterioration of the resin due to cross-linking reaction, etc., tends to be accelerated, resulting in poor moldability.

The aliphatic diamine as the monomer of the aromatic polyamide resin used in the present invention comprises a linear diamine (n-isomer) and a branched diamine (i-isomer). The molar ratio of the linear diamine (n-isomer) content to the branched diamine (i-isomer) content ((linear diamine (n-isomer) content)/(branched diamine (i-isomer) content); hereinafter referred to merely as "n/i ratio") is usually less than 4.0, preferably not more than 3.0. When the n/i ratio is not less than 4.0, the melting point and crystallinity of the obtained aromatic polyamide resin tend to become too high, thereby failing to obtain the aimed bonded magnet having an excellent mechanical strength. The higher content of the branched diamine leads to a lower melting point and a lower crystallinity of the obtained aromatic polyamide resin, thereby attaining a high toughness required for bonded magnets. The lower limit of the n/i ratio is preferably about 0.8.

In order to adjust the n/i ratio of the aliphatic diamine to less than 4.0, the amounts of the linear diamine and the branched diamine mixed may be suitably controlled, for example, upon the synthesis of the polyamide.

Meanwhile, in the case where ferrite particles are used as the magnetic particles, the n/i ratio of the aliphatic diamine is preferably not more than 1.5 because a high filling property, a high orientation rate and a high fluidity are required for improving magnetic properties of the resultant resin composition.

The aromatic polyamide resin used in the present invention has a melting point of preferably not less than 250° C. The upper limit of the melting point of the aromatic polyamide resin is preferably less than 320° C. When the melting point of the aromatic polyamide resin is less than 250° C., the obtained molded product tends to be unsuitable for use in applications requiring a high heat resistance because of a deteriorated heat resistance thereof. When the melting point of the aromatic polyamide resin is not less than 250° C., it may be difficult to subject the resultant resin composition to molding process since the melting point of the resin becomes close to its decomposition temperature. Further, since such an aromatic polyamide resin exhibits a high crystallinity and a high hardness, the toughness thereof tends to be deteriorated, resulting in defects such as breakage of runners upon injection molding and rupture of the obtained molded product as well as low productivity.

Preferred is the aromatic polyamide resin having an end group ratio of 0.1 to 1.0 and an n/i ratio of less than 4.0. By using the aromatic polyamide resin capable of simultaneously satisfying both the above-specified end group ratio and n/i ratio, occurrence of defects such as deterioration of resin upon molding, increased viscosity, breakage of runners upon molding, and rupture or breakage of the obtained molded product can be effectively prevented, thereby enabling production of a bonded magnet exhibiting excellent mechanical strength and heat resistance at a high yield.

Examples of the magnetic particles used in the present invention may include ferrite particles, rare earth magnetic particles or the like.

As the ferrite particles, there may be used magnetoplumbite-type ferrite particles. Specific examples of the magnetoplumbite-type ferrite particles may include barium ferrite particles, strontium ferrite particles and barium-strontium ferrite particles, which are represented by the formula: $AO \cdot nFe_2O_3$ (wherein A is Ba, Sr or Ba—Sr; and n is 5.0 to 6.5), as well as particles obtained by incorporating into these ferrite particles, at least one element selected from the group consisting of Ti, Mn, Al, La, Zn, Bi and Co in an amount of preferably 0.1 to 7.0 mol %.

The ferrite particles have an average particle diameter of preferably 1.0 to 5.0 $\mu$m, more preferably 1.0 to 2.0 $\mu$m; a BET specific surface area value of preferably 1 to 10 $m^2/g$, more preferably 1 to 5 $m^2/g$; a coercive force IHc of preferably 119 to 557 kA/m (1,500 to 7,000 Oe), more preferably 119 to 398 kA/m (1,500 to 5,000 Oe); and a residual magnetization value of preferably 100 to 300 mT (1,000 to 3,000 G), more preferably 100 to 200 mT (1,000 to 2,000 G).

The rare earth magnetic particles are metal compound particles composed of at least one rare earth element and at least one transition metal. Examples of the rare earth magnetic particles may include magnetic particles such as rare earth cobalt-based particles, rare earth-iron-boron-based particles and rare earth-iron-nitrogen-based particles. Among these rare earth magnetic particles, especially preferred are rare earth-iron-boron-based particles and rare earth-iron-nitrogen-based particles because of production of bonded magnets having excellent magnetic properties.

The rare earth magnetic particles have an average particle diameter of preferably 1 to 120 $\mu$m, more preferably 1 to 80 $\mu$m; a BET specific surface area value of preferably 0.5 to 5 $m^2/g$, more preferably 0.5 to 3 $m^2/g$; a coercive force IHc of preferably 239 to 1,591 kA/m (3.0 to 20 kOe), more preferably 318 to 1,114 kA/m (4.0 to 15 kOe); and a residual magnetization value of preferably 0.3 to 1.8 mT (3.0 to 18 kG), more preferably 0.5 to 1.3 mT (5.0 to 13 kG).

Meanwhile, for example, Nb—Fe—B-based magnetic particles may be directly kneaded with the resin. However, in the case where the Nb—Fe—B-based magnetic particles are in the form of thin flake-like particles, the particles are preferably pulverized into those having an average particle diameter of not more than 100 $\mu$m prior to the kneading using a jet mill, an atomizer, a ball mill, etc., in order to attain higher fluidity and magnetic properties of the resultant resin composition.

These magnetic particles may be preferably subjected to various surface treatments in order to prevent deterioration of magnetic properties thereof due to oxidation, and improve the compatibility with resins and the strength of the resultant molded product.

As the coating material usable in the surface treatments, there may be used silane-based coupling agents, titanium-based coupling agents, aluminum-based coupling agents, siloxane polymers, organic phosphoric acid-based surface-treating agents, inorganic phosphoric acid-based surface-treating agents or the like. Among these coating materials, preferred are silane-based coupling agents, because the obtained molded products are considerably improved in strength by previously treating the surface of the magnetic particles therewith.

The content of the magnetic particles in the resin composition for bonded magnet is usually 80 to 95% by weight. When the content of the magnetic particles is less than 80% by weight, it may be difficult to attain the aimed magnetic properties. When-the content of the magnetic particles is more than 95% by weight, the obtained bonded magnet tends to be deteriorated in mechanical strength, and especially tends to suffer from extreme deterioration in moldability such as fluidity and recycling property.

The resin composition for bonded magnet according to the present invention may optionally contain resins other than the aromatic polyamide resins, lubricants and various stabilizers for plastic molding, or the like.

As the other resins added to the resin composition, there may be used aliphatic polyamide resins exhibiting a good affinity with the aromatic polyamide resin used in the present invention. In the consideration of good stability of the obtained resin composition, as the other resins, there may be used polyolefin-based resins such as polyethylene resins, polypropylene resins, polybutene resins and polymethylpentene resins. The amount of the resins other than the aromatic polyamide resin added is usually not more than 2% by weight, preferably 0.1 to 1.0% by weight based on the weight of the resin composition.

Examples of the lubricants may include carboxyl-saturated or unsaturated fatty acid-based lubricants such as propionic acid, stearic acid, linoleic acid, oleic acid, malonic acid, glutaric acid, adipic acid, maleic acid and fumaric acid; various compounds of these acids, for example, metallic soaps such as calcium stearate, magnesium stearate and lithium stearate, fatty acid amides such as hydroxydistearamide, ethylene-bis-laurylamide and ethylene-bis-oleamide, waxes such as paraffin waxes, polysiloxanes such as dimethyl polysiloxanes and silicone oils, fluorine-containing compounds such as fluorine-containing oils, or the like. The amount of the lubricant added is usually not more than 2% by weight, preferably 0.05 to 1.0% by weight based on the weight of the resin composition.

Examples of the stabilizers may include hindered amine-based stabilizers, hindered or less-hindered phenol-based stabilizers such as pentaerythrityl-tetrakis (3-(3,5-di-t-butyl-4-hydroxyphenyl)propionate) , metal deactivators such as N,N'-bis(3-(3,5-di-t-butyl-4-hydroxyphenyl)propionyl hydrazine), phosphite-based antioxidants, thioether-based antioxidants, or the like. In particular, it is preferred to use the hindered or less-hindered phenol-based stabilizer in combination with the phosphite-based antioxidant or the metal deactivator. The amount of the stabilizer added is usually not more than 2% by weight, preferably 0.05 to 1.0% by weight based on the weight of the resin composition.

The resin composition for bonded magnet may further contain, if required, various additives such as pigments, modifiers for plastics, compatibilizing agents, or the like. Meanwhile, the above additives are preferably added in a minimum amount in order to prevent decomposition and gasification thereof upon molding.

The resin composition for bonded magnet according to the present invention has a fluidity (MFR value) of usually 70 to 500 g/10 min, preferably 100 to 500 g/10 min; and a torque increasing time upon kneading by plastomill of usually 15 to 60 minutes, preferably 20 to 60 minutes.

The bonded magnet of the present invention has an IZOD impact strength of usually 10 to 20 kJ/m$^2$ and a flexural strength of usually 100 to 180 MPa when measured by the below-mentioned methods.

Next, the process for producing the resin composition for bonded magnet according to the present invention is described.

In the production process of the present invention, the method of mixing the respective components is not particularly restricted, and may be performed, for example, using a mixer such as ribbon blender, tumbler, Nauter mixer, Henschel mixer and super mixer, or a kneader such as Banbury mixer, kneader, rolls, kneader ruder, single-screw extruder and twin-screw extruder.

The respective components are mixed together to obtain a resin composition for bonded magnet in the form of a powder or pellets. In the consideration of good handling property, the resin composition is preferably in the form of pellets.

The thus obtained resin composition for bonded magnet is molded using various molding machines for thermoplastic resins, preferably using an injection-molding machine or an extrusion-molding machine to obtain a bonded magnet.

In general, since the rare earth magnetic particles used in bonded magnets are active and a high temperature is used upon kneading, injection-molding and extrusion-molding, the conventional resin compositions for bonded magnet tend to suffer from increased viscosity and solidification due to change in quality of the resin and, therefore, be deteriorated in fluidity. This phenomenon causes defects such as poor moldability and deteriorated strength of the obtained molded product. Accordingly, conventionally, it is necessary to minimize deterioration in quality of the aromatic polyamide resin in order to ensure recycling of defective molded products or runners.

On the other hand, in the resin composition for bonded magnet according to the present invention, since the residual percentage of the end amino groups in the aromatic polyamide resin is increased by reducing the end group ratio thereof, it is possible to improve its fluidity as well as its torque increasing time upon kneading by plastomill. The reason therefor is considered as follows, though not clearly known. That is, it is considered that the reduction in end group ratio of the aromatic polyamide resin leads to enhancement in affinity of the aromatic polyamide resin to the magnetic particles, improvement in fluidity of the resin composition, and prevention of deterioration in quality of the resin. Further, it is expected that the improved fluidity of the resin composition results in improved moldability, and low processing temperature and less load applied onto processing machines as well as enhanced productivity.

The above improvement in torque increasing time upon kneading by plastomill means the decrease of a resin viscosity-increasing velocity due to cross-linking reaction as well as improvement in toughness, strength and recycling property of the resin composition. As a result, the resin composition for bonded magnet according to the present invention is excellent in moldability such as fluidity and recycling property, so that the lubricants or resin stabilizers ordinarily used therein can be reduced or is omitted.

The bonded magnets using the conventional aromatic polyamide resins generally show a low IZOD impact strength and a small shrinkage rate in spite of high flexural strength thereof and, therefore, suffer from defects such as rupture of products and breakage of runners upon removal of injection-molded products. As a result, it has been impossible to produce the bonded magnets by continuous molding process.

On the other hand, the resin composition for bonded magnet according to the present invention is improved in toughness of the resin, so that it becomes possible to produce the bonded magnet by continuous molding process. The reason therefor is considered as follows. That is, since the increase of the branched amine content causes reduction in crystallinity of the resin, thereby improving the toughness of the resin. As a result, since the resin has a toughness sufficient to withstand impact forces applied upon the mold opening and upon ejection of the products from the mold, it becomes possible to produce the bonded magnet by continuous molding process.

Also, it is considered that the reduced crystallinity of the resin causes the decrease in melting point and crystallization velocity. The decrease of the melting point leads to reduction in molding temperature, so that it becomes possible to minimize the deterioration in qualities of the resin and magnetic particles upon molding. Although it may be suggested that the decreased melting point causes deterioration in the aimed heat resistance of the bonded magnet, the deflection temperature under load of the bonded magnet according to the present invention is as high as not less than 200° C. and is higher than any of deflection temperatures under load of bonded magnets using 6 nylon (about 170° C.) and using 12 nylon (about 150° C.). Therefore, the bonded magnet of the present invention has properties sufficient to withstand reflow soldering, etc. Further, it is considered that the decreased crystallization velocity inhibits occurrence of shrinkage cracks and sink marks due to abrupt temperature drop upon filling the resin into injection-molding machine.

As described above, by adjusting the n/i ratio of the aliphatic diamine and controlling the melting point of the aromatic polyamide resin, it may be possible to impart a sufficient mechanical strength to the bonded magnet.

The resin composition according to the present invention can exhibit an excellent moldability by appropriately controlling the molar ratio between the residual end amino groups content and the residual end carboxyl groups content in the aromatic polyamide resin and, therefore, is suitable as a resin composition for bonded magnet.

Also, the resin composition according to the present invention is excellent in moldability and toughness by appropriately controlling the ratio between the linear diamine content and branched diamine content in the aliphatic diamine and, therefore, is suitable as a resin composition for bonded magnet.

Accordingly, the bonded magnet of the present invention can exhibit excellent mechanical strength and heat resistance.

EXAMPLES

The present invention is described in more detail by Examples and Comparative Examples, but the Examples are only illustrative and, therefore, not intended to limit the scope of the present invention.

Various properties were measured and evaluated by the following methods.

(1) The amounts of respective reactive end groups contained in the aromatic polyamide resin were determined as follows. That is, the concentrations of the respective end groups were obtained from the ratio between the main chain and the end groups measured by the following NMR method:

Apparatus: JOEL GX-400 (manufactured by Nippon Denshi Co., Ltd.)

Solvent: deuterided trifluoroacetic acid (1/4)

Sample concentration: 1.0%

(2) The solution viscosity was determined as follows. That is, 50 mg of dried polymer was dissolved in concentrated sulfuric acid to prepare 25 cc of a sulfuric acid solution of the polymer. Then, the obtained solution was introduced into an Ubbelohde viscometer (30° C./water 20) through a glass filter "115AG P100" and subjected to a drop test in a constant-temperature water bath at 30° C. to measure a drop time of the sulfuric acid solution.

Meanwhile, the drop test was repeated until the difference between two drop times measured was within 0.15 second. The average value of the two drop times was expressed by "t". Also, the concentrated sulfuric acid solely was subjected to the similar drop test to measure its drop time "t0" as a blank value.

The solution viscosity (ηinh) was calculated according to the following formula:

$$\eta inh(dl/g)=(\ln(t/t0))+(4\times(\text{amount of polymer sampled (g)})$$

wherein the fractions are rounded off to two decimal places.

(3) The melting point of the aromatic polyamide resin was measured using "DSC220" (manufactured by Seiko Instruments Co., Ltd.) by differential scanning calorimetry (DSC) according to JIS K7121.

(4) The average particle diameter of the magnetic particles was expressed by an average of values measured by an electron microscope.

(5) The specific surface area value was expressed by the value measured by BET method.

(6) The fluidity (MFR) of the resin composition for bonded magnet was measured at a heating cylinder temperature of 330° C. under a load of 10 kgf using a melt indexer "Model P-101" (manufactured by Toyo Seiki Seisakusho Co., Ltd.).

(7) The deterioration in properties of resin contained in the resin composition for bonded magnet was evaluated as follows. That is, 60 cc of pellets of the resin composition for bonded magnet (the value was calculated from compound true density) were charged into a labo-plastomill "Model 30C-150" (manufactured by Toyo Seiki Seisakusho Co., Ltd.), and kneaded at a temperature of 330° C. and a screw-rotating speed of 50 rpm to measure a kneading torque as required during the kneading. The time period elapsed from initiation of the kneading up to the time at which the kneading torque exceeded 1.5 kg·m, was measured and regarded as a torque increasing time.

(8) The injection moldability of the resin composition using rare earth magnetic particles as the magnetic particles was evaluated by the following three ranks:

A: Continuous molding was possible;

B: Few short shots were recognized; and

C: Short shots were frequently recognized (impossible to produce a bonded magnet by molding).

(9) The injection moldability of the resin composition using ferrite particles as the magnetic particles was evaluated by the following three ranks:

A: Continuous molding was possible;

B: Few broken runners and sprues were recognized; and

C: Broken runners and sprues were frequently recognized (impossible to produce a bonded magnet by molding).

(10) The magnetic properties of the bonded magnet were determined as follows. That is, a cylindrical bonded magnet having a size of ϕ10 mm×7 mm was produced using an injection-molding machine "Model J-20MII" (manufactured by Nippon Seikosho Co., Ltd.), and the magnetic properties of the obtained bonded magnet were measured at ordinary temperature using an rare earth temperature coefficient measuring device "Model TRF-5BH-25auto" (manufactured by Toei Kogyo Co., Ltd.).

Meanwhile, the magnetic properties of the magnetic particles were measured using a vibration sample magnetometer "VSM-3S-15" (manufactured by Toei Kogyo Co., Ltd.) by applying an external magnetic field of 795.8 kA/m (10 koe) thereto.

(11) The mechanical strength of the bonded magnet was determined as follows. That is, a plate-shaped bonded magnet having a size of 80 mm×12 mm×3 mm was produced using an injection-molding machine "Model J-20MII" (manufactured by Nippon Seikosho Co., Ltd.), and the flexural strength of the obtained bonded magnet was measured using an autograph "Model AG-10kNI" (manufactured by Shimadzu Seisakusho Co., Ltd.), and further the IZOD impact value thereof was measured using an IZOD impact tester (manufactured by Yasuda Seiki Seisakusho Co., Ltd.).

(12) The deflection temperature under load of the bonded magnet was determined as follows. That is, a plate-shaped bonded magnet having a size of 125 mm×13 mm×4 mm was produced using an injection-molding machine "Model J-20MII" (manufactured by Nippon Seikosho Co., Ltd.), and the deflection temperature under load of the obtained bonded magnet was measured using an HDT tester "Model S-3M" (manufactured by Toyo Seiki Seisakusho Co., Ltd.).

Example 1

<Production of Bonded Magnet I>

90.5 g (90.5% by weight) of Nd—Fe—B-based magnetic particles (average particle diameter: 70 μm; coercive force: 748 kA/m (9.4 kOe); residual magnetization value: 875 mT (8,750 G)) and 0.5 g (0.5% by weight) of a 50% 2-propanol-diluted solution of a silane-based coupling agent "A-1100" (produced by Nihon Unicar Co., Ltd.) were charged into a Henschel mixer, and heated at 100° C. under stirring, thereby treating the surface of the Nd—Fe—B-based magnetic particles with the silane-based coupling agent. Then, the surface-treated magnetic particles were intimately mixed and stirred with 9.0 g (9.0% by weight) of an aromatic polyamide resin ("Cenesta" produced by Kuraray Co., Ltd.; solution viscosity: 0.7 dl/g; end group ratio: 0.3; melting point: 303° C.; amount of residual end amino groups: 1.01 mol %). The resultant mixture was extruded from a 20 mmϕ twin-screw extruder with a 3 mmϕ die at a screw-rotating speed of 96 rpm and a cylinder temperature of 310° C., and cut into pellets each having a size of 3 mmϕ×4 mm as a resin composition for bonded magnet.

The thus obtained resin composition for bonded magnet in the form of pellets had a fluidity (MFR value) of 161 g/10 min as measured at a heating cylinder temperature of 330° C. under a load of 10 kgf, and a torque increasing time of 36 minutes.

The pellets of the obtained resin composition for bonded magnet were injection-molded at a molding temperature of 280 to 320° C. and a die temperature of 110 to 140° C. using an injection-molding machine "Model J-20MII" (manufactured by Nippon Seikosho Co., Ltd.), thereby obtaining a cylindrical rare earth-based bonded magnet having a size of ϕ10 mm×7 mm and a plate-shaped rare earth-based bonded magnet having a size of 80 mm×12 mm×3 mm. The injection moldability of the resin composition was the rank A, i.e., it was possible to produce the bonded magnets by continuous injection-molding process.

As to the magnetic properties of the thus obtained bonded magnet, it was confirmed that the residual magnetic flux density thereof was 530 mT (5.3 kG); the coercive force thereof was 716 kA/m (9.0 kOe); and the maximum magnetic energy product thereof was 45.3 kJ/m$^3$ (5.7 MGOe). In addition, it was confirmed that the bonded magnets had a deflection temperature under load of 209° C.

Example 2

<Production of Bonded Magnet II-1: Rare Earth-based Bonded Magnet>

89.5 g (89.5% by weight) of Nd—Fe—B-based magnetic particles (average particle diameter: 70 μm; coercive force: 748 kA/m (9.4 kOe); residual magnetization value: 875 mT (8,750 G)) and 0.5 g (0.5% by weight) of a 50% 2-propanol-diluted solution of a silane-based coupling agent "AA-1100" (produced by Nihon Unicar Co., Ltd.) were charged into a Henschel mixer, and heated at 100° C. under stirring, thereby treating the surface of the Nd—Fe—B-based magnetic particles with the silane-based coupling agent. Then, the surface-treated magnetic particles were intimately mixed and stirred with 9.5 g (9.5% by weight) of an aromatic polyamide resin ("Genesta" produced by Kuraray Co., Ltd.; solution viscosity: 0.68 dl/g; end group ratio: 0.45; n/i ratio: 1.0; melting point: 275° C.; amount of residual end amino groups: 0.86 mol %) and 0.5 g (0.5% by weight) of an olefin-based additive ("Biscol 550P" produced by Sanyo Kasei Kogyo Co., Ltd.). The resultant mixture was extruded from a 20 mmϕ twin-screw extruder with a 3 mmϕ die at a screw-rotating speed of 96 rpm and a cylinder temperature of 290° C., and cut into pellets each having a size of 3 mmϕ×4 mm as a resin composition for bonded magnet.

The thus obtained resin composition for bonded magnet in the form of pellets had a fluidity (MFR value) of 450 g/10 min as measured at a heating cylinder temperature of 330° C. under a load of 10 kgf, and a torque increasing time of 36 minutes.

The pellets of the obtained resin composition for bonded magnet were injection-molded at a molding temperature of 280 to 320° C. and a die temperature of 110 to 140 using an injection-molding machine "Model J-20MII" (manufactured by Nippon Seikosho Co., Ltd.), thereby obtaining a cylindrical rare earth-based bonded magnet having a size of ϕ10 mm×7 mm and a plate-shaped rare earth-based bonded magnet having a size of 80 mm×12 mm×3 mm. The injection moldability of the resin composition was the rank A, i.e., it was possible to produce the bonded magnets by continuous injection-molding process.

As to the magnetic properties of the thus obtained bonded magnets, it was confirmed that the residual magnetic flux density thereof was 500 mT (5.0 kG); the coercive force thereof was 724 kA/m (9.1 koe); and the maximum magnetic energy product thereof was 40.6 kJ/m$^3$ (5.1 MGOe). In addition, it was confirmed that the bonded magnets had an IZOD impact strength of 14.0 kJ/m$^2$, a flexural strength of 117 MPa and a deflection temperature under load of 202° C.

Example 3

<Production of Bonded Magnet II-2: Ferrite-based Bonded Magnet>85.7 g (85.7% by weight) of ferrite particles (strontium ferrite; average particle diameter: 1.3 μm; BET specific surface area value: 1.65 m$^2$; coercive force: 223 kA/m (2.8 koe); residual magnetization value: 177 mT (1,770 G)) and 0.5 g (0.5% by weight) of a 50% 2-propanol-diluted solution of a silane-based coupling agent "A-1100" (produced by Nihon Unicar Co., Ltd.) were charged into a Henschel mixer, and heated at 100° C. under stirring, thereby treating the surface of the ferrite particles with the silane-based coupling agent. Then, the surface-treated ferrite particles were intimately mixed and stirred with 13.8 g (13.8% by weight) of an aromatic polyamide resin ("Genesta" produced by Kuraray Co., Ltd.; solution viscosity: 0.90 dl/g; n/i ratio: 1.0; melting point: 275° C.; amount of residual end amino groups: 0.5 mol %). The resultant mixture was extruded from a 20 mmϕ twin-screw extruder with a 3 mmϕ die at a screw-rotating speed of 96 rpm and a cylinder temperature of 290° C., and cut into pellets each having a size of 3 mmϕ×4 mm as a resin composition for bonded magnet.

The thus obtained resin composition for bonded magnet in the form of pellets had a fluidity (MFR value) of 105 g/10 min as measured at a heating cylinder temperature of 340° C. under a load of 10 kgf.

The pellets of the obtained resin composition for bonded magnet were injection-molded at a molding temperature of 280 to 320° C., a die temperature of 110 to 140° C. and an orientation magnetic field of 8 kOe using an injection-molding machine "Model J-20MII" (manufactured by Nippon Seikosho Co., Ltd.), thereby obtaining a cylindrical ferrite-based bonded magnet having a size of ϕ10 mm×7 mm and a plate-shaped ferrite-based bonded magnet having a size of 80 mm×12 mm×3 mm. The injection moldability of the resin composition was the rank A, i.e., it was possible to produce the bonded magnets by continuous injection-molding process, and no broken runner was recognized among 10 runners.

As to the magnetic properties of the thus obtained bonded magnets, it was confirmed that the residual magnetic flux density thereof was 250 mT (2.5 kG); the coercive force thereof was 239 kA/m (3.0 koe); and the maximum magnetic energy product thereof was 12.1 kJ/m$^3$ (1.52 MGOe).

Example 4

<Production of Bonded Magnet III>

91.5 g (91.5% by weight) of Nd—Fe—B-based magnetic particles (average particle diameter: 70 μm; coercive force: 748 kA/m (9.4 kOe); residual magnetization value: 875 mT (8,750 G)) and 0.5 g (0.5% by weight) of a 50% 2-propanol-diluted solution of a silane-based coupling agent "A-1100" (produced by Nihon Unicar Co., Ltd.) were charged into a Henschel mixer, and heated at 100° C. under stirring, thereby treating the surface of the Nd—Fe—B-based magnetic particles with the silane-based coupling agent. Then, the surface-treated magnetic particles were intimately mixed and stirred with 7.5 g (7.5% by weight) of an aromatic polyamide resin ("Genesta" produced by Kuraray Co., Ltd.; solution viscosity: 0.65 dl/g; end group ratio; 0.4; n/i ratio: 1.0; melting point: 275° C.; amount of residual end amino groups: 0.8 mol %) and 0.5 g (0.5% by weight) of an olefin-based additive. The resultant mixture was extruded from a 20 mmϕ twin-screw extruder with a 3 mmϕ die at a screw-rotating speed of 96 rpm and a cylinder temperature of 290° C., and cut into pellets each having a size of 3 mmϕ×4 mm as a resin composition for bonded magnet.

The thus obtained resin composition for bonded magnet in the form of pellets had a fluidity (MFR value) of 430 g/10 min as measured at a heating cylinder temperature of 330° C. under a load of 10 kgf, and a torque increasing time of 36 minutes.

The obtained pellets of the resin composition for bonded magnet were injection-molded at a molding temperature of 280 to 320° C. and a die temperature of 110 to 140° C. using an injection-molding machine "Model J-20MII" (manufactured by Nippon Seikosho Co., Ltd.), thereby obtaining a cylindrical rare earth-based bonded magnet having a size of ϕ10 mm×7 mm and a plate-shaped rare earth-based bonded magnet having a size of 80 mm×12 mm×3 mm. The injection moldability of the resin composition was the rank A, i.e., it was possible to produce the bonded magnets by continuous injection-molding process.

As to the magnetic properties of the thus obtained bonded magnets, it was confirmed that the residual magnetic flux density thereof was 540 mT (5.4 kG); the coercive force thereof was 724 kA/m (9.1 kOe); and the maximum magnetic energy product thereof was 50.9 kJ/m3 (6.5 MGOe). In addition, it was confirmed that the bonded magnets had an IZOD impact strength of 10.3 kJ/m$^2$, a flexural strength of 102 MPa and a deflection temperature under load of 215° C.

Examples A to D and Comparative Examples a

<Resin Composition for Bonded Magnet>

The same procedure as defined in Example 1: production of bonded magnet I was conducted except that the solution viscosity and end group ratio of the aromatic polyamide resin were changed variously, thereby obtaining bonded magnets.

Figure 2:
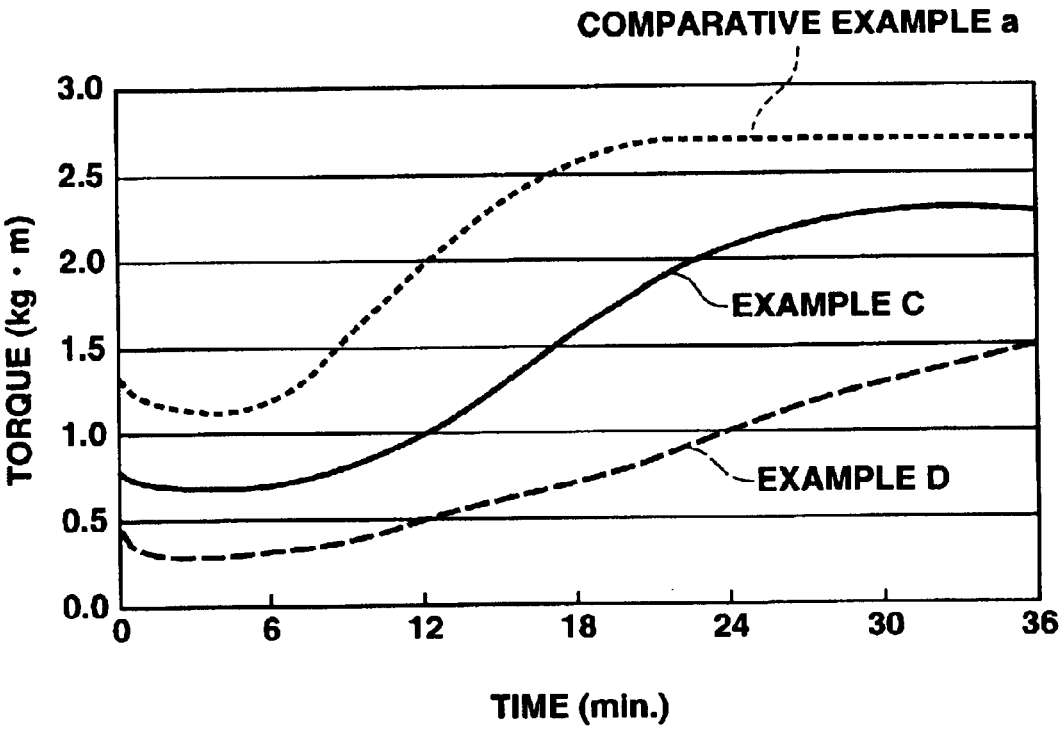
FIG. 2 is a graph showing the change in kneading torque of resin compositions obtained in Examples C and D and Comparative Example a with the passage of time upon a solution viscosity of 0.70 dl/g.

Essential production conditions and various properties of the obtained bonded magnets are shown in Table 1, and the changes in torque upon kneading are shown in FIGS. 1 and 2.

From these Examples and Comparative Example, it was confirmed that when the end group ratio was not more than 1.0, the torque increasing time was prolonged and, therefore, the resin composition exhibited an excellent fluidity.

Examples E and F and Reference Example b

<Resin Composition for Bonded Magnet>

The same procedure as defined in Example 2 for production of bonded magnet II-1 was conducted except that the n/i ratio of the aromatic polyamide resin was changed variously, thereby obtaining rare earth-based bonded magnets.

Essential production conditions and various properties of the obtained rare earth-based bonded magnets are shown in Table 2.

Examples G to I and Comparative Examples c and d

<Resin composition for Bonded Magnet>

The same procedure as defined in Example 3 for production of bonded magnet II-2 was conducted except that the n/i ratio of the aromatic polyamide resin was changed variously, thereby obtaining ferrite-based bonded magnets.

Essential production conditions and various properties of the obtained ferrite-based bonded magnets are shown in Table 3.

From these Examples and Comparative Examples, it was confirmed that when the end group ratio was 0.1 to 1.0 and the n/i ratio was less than 4.0, the obtained bonded magnets had both a higher IZOD impact strength and a higher flexural strength. Further, the breakage of runners upon molding was prevented when the n/i ratio was less than 4.0.

Examples J to L and Comparative Example e

<Resin composition for Bonded Magnet>

The same procedure as defined in Example 4 for production of bonded magnet III was conducted except that the end group ratio and n/i ratio of the aromatic polyamide resin were changed variously, thereby obtaining bonded magnets.

Essential production conditions and various properties of the obtained bonded magnets are shown in Table 4. Meanwhile, in Table 4, "PA9T" represents 9T nylon as the aromatic polyamide resin.

From Examples J to L, it was confirmed that when the end group ratio was not more than 1.0, the torque increasing time was prolonged and, therefore, the resin composition exhibited an excellent fluidity. Further, when the resin composition containing the aromatic polyamide resin having an n/i ratio of less than 4.0 was used, the obtained bonded magnets had both a high IZOD impact strength and a high flexural strength.

TABLE 1

| Examples and Comparative Example | Solution viscosity (dl/g) | End group ratio (–) | Melting point (° C.) | Amount of residual end amino groups (mol %) | MFR (g/10 min) | Injection-molding | Torque increasing time (min) |
|---|---|---|---|---|---|---|---|
| Example A | 0.65 | 0.6 | 302 | 0.72 | 142 | A | 27.5 |
| Example B | 0.65 | 0.2 | 304 | 1.21 | 220 | A | >36.0 |
| Example C | 0.70 | 0.6 | 302 | 0.70 | 100 | B | 15.5 |
| Example D | 0.70 | 0.3 | 303 | 1.01 | 161 | A | 36.0 |
| Comparative Example a | 0.70 | 2.9 | 301 | 0.34 | 51 | C | 8.5 |

TABLE 2

| Examples and Reference Example | Magnetic particles | n/i ratio | End group ratio | Solution viscosity (dl/g) | Melting point (° C.) | Amount of residual end amino groups (mol %) | Injection -molding pressure (MPa) | MFR (g/10 min) | IZOD (kJ/m$^2$) | Flexural strength (MPa) |
|---|---|---|---|---|---|---|---|---|---|---|
| Example E | NdFeB | 1 | 0.45 | 0.68 | 275 | 0.86 | 72.3 | 450 | 14 | 117 |
| Example F | NdFeB | 2.7 | 0.28 | 0.68 | 293 | 1.06 | 81.5 | 350 | 15.8 | 129 |
| Reference Example b | NdFeB | 5.6 | 0.27 | 0.68 | 304 | 1.11 | 93.2 | 320 | 9.9 | 102 |

TABLE 3

| Examples and Comparative Examples | Magnetic particles | n/i ratio | End group ratio | Resin viscosity (dl/g) | Melting point (° C.) | MFR (g/10 min) | Injection-molding | Number of broken runners |
|---|---|---|---|---|---|---|---|---|
| Example G | Ferrite | 1 | — | 0.9 | 275 | 105 | A | 0/10 |
| Example H | Ferrite | 1.5 | — | 1.05 | 280 | 72 | B | 1/10 |
| Example I | Ferrite | 1.5 | — | 0.88 | 280 | 121 | B | 2/10 |
| Comparative Example c | Ferrite | 4 | — | 0.91 | 300 | 100 | C | 10/10 |
| Comparative Example d | Ferrite | 5.6 | — | 0.87 | 305 | 120 | C | 10/10 |

TABLE 4

| Examples and Comparative Example | Resin | n/i ratio | End group ratio | Resin viscosity (dl/g) | Melting point (° C.) | Amount of residual end amino groups (mol %) | MFR (g/10 min) | Torque increasing time (min) | IZOD (kJ/m$^2$) |
|---|---|---|---|---|---|---|---|---|---|
| Example J | PA9T*1) | 1 | 0.44 | 0.65 | 275 | 0.8 | 430 | >36.0 | 10.3 |
| Example K | PA9T | 1.5 | 0.73 | 0.65 | 280 | 0.71 | 420 | >36.0 | 11.8 |

TABLE 4-continued

| Examples and Comparative Example | Resin | n/i ratio | End group ratio | Resin viscosity (dl/g) | Melting point (° C.) | Amount of residual end amino groups (mol %) | MFR (g/10 min) | Torque increasing time (min) | IZOD (kJ/m$^2$) |
|---|---|---|---|---|---|---|---|---|---|
| Example L | PA9T | 2.3 | 1.00 | 0.66 | 289 | 0.63 | 290 | 30.5 | 12.8 |
| Comparative Example e | PPS*2) | — | — | — | — | — | 40 | 8 | 7.4 |

Note:
*1)9T nylon
*2)Polyphenylene sulfide (linear type)

What is claimed is:

1. A resin composition for bonded magnet, comprising:

magnetic particles; and an aromatic polyamide resin comprising an aromatic carboxylic acid and an aliphatic diamine, which has a molar ratio of residual end carboxyl groups to residual end amino groups of 0.1 to 1.0 and a solution viscosity of not more than 1.1 dl/g.

2. A resin composition according to claim 1, wherein the aliphatic diamine comprises a linear diamine and a branched diamine such that a molar ratio of the linear diamine to the branched diamine is less than 4.0.

3. A resin composition according to claim 2, wherein the aromatic polyamide resin has a melting point of from 250° C. to less than 320° C.

4. A resin composition according to claim 1, wherein the resin composition has a melt flow rate (MFR) of 70 to 500 g/10 min, and a torque increasing time upon kneading by plastomill of 15 to 60 minutes.

5. A resin composition for bonded magnet, comprising:

magnetic particles; and an aromatic polyamide resin comprising an aromatic carboxylic acid and an aliphatic diamine comprising a linear diamine and a branched diamine, which has a molar ratio of residual end carboxyl groups to residual end amino groups of 0.1 to 1.0 and a solution viscosity of not more than 1.1 dl/g, a molar ratio of the linear diamine to the branched diamine being less than 4.0.

6. A resin composition for bonded magnet, comprising:

magnetic particles; and an aromatic polyamide resin comprising an aromatic carboxylic acid and an aliphatic diamine comprising a linear diamine and a branched diamine, which has a molar ratio of residual end carboxyl groups to residual end amino groups of 0.1 to 1.0 and a solution viscosity of not more than 1.1 dl/g, a molar ratio of the linear diamine to the branched diamine being less than 4.0, and the resin composition having a melt flow rate (MFR) of 70 to 500 g/10 min, and a torque increasing time upon kneading by plastomill of 15 to 60 minutes.

7. A resin composition for bonded magnet, comprising:

magnetic particles; and an aromatic polyamide resin comprising an aromatic carboxylic acid and an aliphatic diamine comprising a linear diamine and a branched diamine, which has a solution viscosity of not more than 1.1 dl/g, a molar ratio of the linear diamine to the branched diamine being less than 4.0.

8. A bonded magnet obtained by molding the resin composition as defined in claim 1.

9. A bonded magnet according to claim 8, wherein said bonded magnet has an IZOD impact strength of 10 to 20 kJ/m$^2$ and a flexural strength of 100 to 180 MPa.

10. A bonded magnet obtained by molding a resin composition comprising magnetic particles and an aromatic polyamide resin comprising an aromatic carboxylic acid and an aliphatic diamine, which has a molar ratio of residual end carboxyl groups to residual end amino groups of 0.1 to 1.0 and a solution viscosity of not more than 1.1 dl/g, the bonded magnet having an IZOD impact strength of 10 to 20 kJ/m$^2$ and a flexural strength of 100 to 180 MPa.

11. A bonded magnet obtained by molding a resin composition comprising magnetic particles and an aromatic polyamide resin comprising an aromatic carboxylic acid and an aliphatic diamine comprising a linear diamine and a branched diamine, which has a molar ratio of residual end carboxyl groups to residual end amino groups of 0.1 to 1.0 and a solution viscosity of not more than 1.1 dl/g, a molar ratio of the linear diamine to the branched diamine beimg less than 4.0, and the bonded magnet having an IZOD impact strength of 10 to 20 kJ/m$^2$ and a flexural strength of 100 to 180 MPa.

12. A bonded magnet obtained by molding the resin composition as defined in claim 7.

* * * * *